United States Patent [19]

Ehlscheid et al.

[11] Patent Number: 4,537,588

[45] Date of Patent: Aug. 27, 1985

[54] PUNCH DEVICE FOR MAKING WINDOW CUT-OUTS

[75] Inventors: Gunter Ehlscheid, Neuwied; Heinz-Helmut Frost, Puderbach, both of Fed. Rep. of Germany

[73] Assignee: Winkler & Dunnerbier Maschinenfabrik und Eisengiesserei GmbH & Co. KG., Neuwied, Fed. Rep. of Germany

[21] Appl. No.: 570,872

[22] Filed: Jan. 16, 1984

[30] Foreign Application Priority Data

Jan. 22, 1983 [DE] Fed. Rep. of Germany ..... 3302038

[51] Int. Cl.[3] ..... B31B 1/24

[52] U.S. Cl. ..... 493/342; 493/471; 493/370; 83/349; 76/107 C

[58] Field of Search ..... 83/349, 348, 98–100, 83/911; 76/107 C, 107 R, 101 A, 101 R; 493/342, 919, 905, 471, 472, 60, 64, 82, 227, 228, 241, 370

[56] References Cited

U.S. PATENT DOCUMENTS

| | | | |
|---|---|---|---|
| 3,010,260 | 11/1961 | Subklew | 493/342 |
| 3,170,342 | 2/1965 | Downie | 76/107 C |
| 3,198,093 | 8/1965 | Kirby et al. | 493/472 |
| 3,274,871 | 9/1966 | Ehlscheid | 83/99 |
| 3,276,306 | 10/1966 | Winkler et al. | 83/311 |
| 3,380,327 | 4/1968 | Stemmler | 83/100 |
| 3,535,955 | 10/1970 | Otto et al. | 76/107 C |
| 3,611,855 | 10/1971 | Thousand | 83/911 |
| 4,393,738 | 7/1983 | Heyden | 83/663 |

FOREIGN PATENT DOCUMENTS

| | | | |
|---|---|---|---|
| 652787 | 11/1937 | Fed. Rep. of Germany . | |
| 670170 | 1/1939 | Fed. Rep. of Germany . | |
| 1962984 | 7/1971 | Fed. Rep. of Germany | 493/471 |
| 11442 | of 1888 | United Kingdom | 493/370 |
| 1339560 | 12/1973 | United Kingdom . | |
| 2078154 | 6/1983 | United Kingdom . | |

*Primary Examiner*—Lowell A. Larson
*Assistant Examiner*—William E. Terrell
*Attorney, Agent, or Firm*—Collard, Roe & Galgano

[57] ABSTRACT

A rotary punch device for making window cut-outs in envelopes and cardboard boxes, with a clamping device for clamping a metal foil having a cutting edge etched out of the foil material. Vacuum bores in the cylindrical surface of the rotary punch retain the material for treatment in position while the punched-out portion of the window is initially also retained by a vacuum and blown away by an air blast on completion of the punch operation.

1 Claim, 5 Drawing Figures

PUNCH DEVICE FOR MAKING WINDOW CUT-OUTS

The present invention relates to a punch device for making window cut-outs and, more particularly, to a rotating punch device for making window cut-outs in envelopes and cardboard boxes.

Punch devices of this kind are presently in use in the production of self-adhesive labels of the kind used today commercially, in the trades, industry, by the authorities and in the home for the purpose of marking articles or addressing items sent through the mails. The backs of these labels are coated with an adhesive and they are disposed on a silicone paper backing strip from which they can readily be removed after being printed or written on. Thus, the self-adhesive labels are made from a laminate consisting of the silicone paper layer, the contact adhesive layer and the label paper all in strip form. This strip is fed to a rotating punch device in which the label paper is cut through down to the silicone paper backing strip between a punch roller and a co-acting roller. After passing this pair of rollers, the silicone paper backing strip with the self-adhesive labels punched out of the same but still situated thereon is wound in the form of an endless strip or deposited as a zig-zag strip. Depending upon the user's requirements, the strip may be divided into individual sheets. Alternatively, that zone of the label paper which accumulates as waste outside the punched-out labels can be separated from the silicone paper and then wound as a cohesive structure so that only the backing strip together with the labels is deposited.

Photosensitively coated metal foils with the etched-out cutting edges have proven to be extremely suitable for the purpose described. A foil of this kind has a thickness of about 0.5 mm. The pattern for the punch out is recorded thereon and after chemical treatment of the foil it remains in the form of an endless cutting edge of a height of about 0.3 mm. The finally treated foil thus has a thickness of about 0.2 mm outside the cutting edge. The attempt is made to accommodate the maximum number of cutting edges adjacent to and consecutively to one another on the foil. For this reason the punch roller is constructed as a magnetic cylinder on which the foil punch adheres without any other mechanical fixing elements. This type of fixing must be selected so that the entire roller circumference can be covered with the foil so that a plurality of blanks can be punched out per revolution and the punched-out labels are disposed in uniform and the closest possible sequence on the silicone paper. This type of fixing is adequate because the forces occurring which can cause the foil punch to slip on the punch roller are relatively small under the conditions applying to label manufacture. There is no abrupt loading at the conventional production speed and the labels are stamped out against the co-rotating, co-operating roller on which the silicone paper acts as a punching support to some extent. There are no other disturbing tangential forces between the punch roller and the co-acting roller, because the conveyance of the strip for punching is not carried out directly by this pair of rollers but by conveyor rollers disposed in front of and after the same.

The prior-art punch devices operating on the rotary principle for making window cut-outs in envelopes and cardboard boxes have punch rollers bearing a tool punch whose cutting edges are made in a number of expensive operations from high-grade tool steel by machining from the solid. Devices of this kind, for example, are disclosed in German Pat. Nos. 652 787, 670 171 and 12 16 085 (corresponding to U.S. Pat. No. 3,276,306). A cutting roller according to German Offenlegungsschrift No. 29 07 325 (corresponding to U.S. Pat. No. 4,393,738) has provided an advance inasmuch as it reduces the machining work, the blade web which bears the cutting edge having its rough contours welded, in a number of superposed beads, on a support made from lower-grade material. Relatively little machining work is now required to make the cutting edge in comparison with the blade machined from the solid. In either case, however, the machining of the tool punch requires extensive heat treatment thereafter. The known tool punches may operate either against a co-rotating roller with a hard surface or against a stationary hard cutter bar of the kind disclosed in German Pat. Nos. 12 15 495 (corresponding to U.S. Pat. No. 3,380,327) and 19 62 984, or German Pat. No. 29 00 994. Because of their simple structure, rotating punch devices of the latter kind are today used preferably in heavy-duty machines for the manufacture of window envelopes with outputs of up to 1,000 per minute.

Both U.S. Pat. Nos. 3,276,306 and 3,380,327, referred to above, disclose apparatus for making window cut-outs, etc. in paper or paperboard blanks and the like. In both patents, the cutting device is carried on a rotating roller on which the blank to be cut is secured by means of vacuum. Also, vacuum secures the window which has been cut from the blank until such time that it is disposed of when an air blast or positive pressure is applied to the window and it is thereby blown away from the roller. These patents describe in full and clear detail the mechanisms for accomplishing the vacuum and air blast including the control head which communicates with the roller containing the vacuum ducts.

The tool punches for current window sizes of standard envelopes must be kept in stock by all envelope manufacturers. To stock and maintain them involves a considerable cost factor to the businesses concerned. Because of the high tool costs, it is only after a certain run that it is economic to use punching tools differing from the standard size or shape. For publicity reasons, however, the window cut-outs of envelopes and cardboard boxes are increasingly required in original fancy shapes. While the tools for window cut-outs with simple geometric shapes can be mechanically produced through all the machining stages up to completion, the production of stamping tools for window cut-outs of irregular fancy shapes requires predominantly manual work. The extremely high tool costs as a result thus immoderately raise the price per envelope for small runs.

It is, therefore, the object of the present invention to provide a rotating punch device for the manufacture of window cut-outs in envelopes and cardboard boxes, which can be made cheaply even for the most complicated window shapes and small runs, and which in respect of the quality of the cut is in no way inferior to the prior art devices. More particularly, it is an object of the present invention to utilize the advantages of photosensitively coated metal foil with an etched-out cutting edge in the shape of the window for punching out, for the manufacture of window cut-outs in envelopes and cardboard boxes. To this end, according to the invention, the metal foil bearing the cutting edge is bent at its ends extending in the direction of the circumference of the punch roller and matchingly shaped tips of retaining and clamping segments engage in the bent ends and permit clamping of the foil in register in the circumferential direction, and the cutting edge acts against a stationary cutting bar.

The present invention will be described and understood more readily when considered together with the accompanying drawings, in which.

Figure 2:
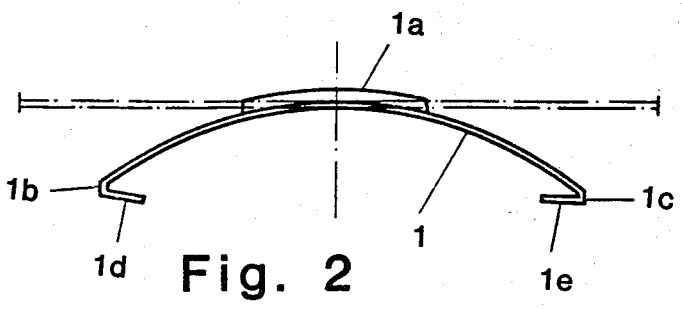
FIG. 2 is a front elevational view of a foil punch etched and bent ready for installation.
Figure 3:
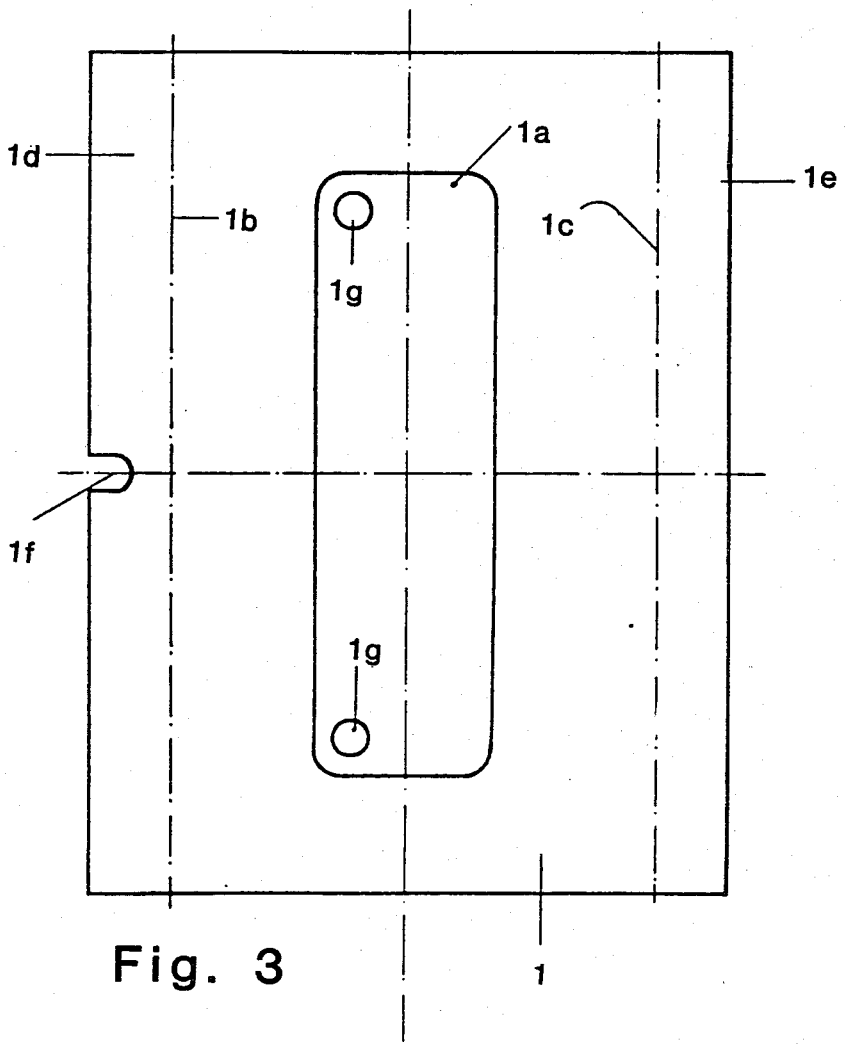
FIG. 3 is a plan view of a completely etched foil punch in the unbent state.

The foil punch, designated 1, shown in FIGS. 2 and 3 is 0.5 mm thick as a starting material and has a photosensitive coating on one side. It can be obtained through the trade in the form of sheets. After cutting to the required size, the cutting edge 1*a* for the window opening which is to be punched out of the blanks is recorded on the coated side. The material inside and outside the cutting edge 1*a* is then removed in an etching bath to a thickness of 0.2 mm. As a result of the relatively long action period of the etching bath, a roof-shaped edge forms starting from the coated side and is suitable, given appropriate pressure, for punching paper or the like. On completion of the etching operation the cutting edge 1*a* will have a height of 0.3 mm. A standard rectangular window with rounded corners is shown in the drawing as an exemplified embodiment of the opening. Of course any other possible window shape can be made without additional expense. Air holes 1*g* are formed in the etched punching foil inside the cutting edge 1*a* and the U-shaped cut-out 1*f* is formed at the leading edge 1*d*. Foil 1 is then bent in a device and at the same time the leading and trailing ends 1*d* and 1*e* extending in the peripheral direction of the punching roller are bent over at the edges 1*b* and 1*c*. The use of a bending device guaranteeing accurate-register clamping on the roller eliminates any tedious adjustment when the foil 1 on the roller 2 has to be replaced due to wear.

Figure 1:
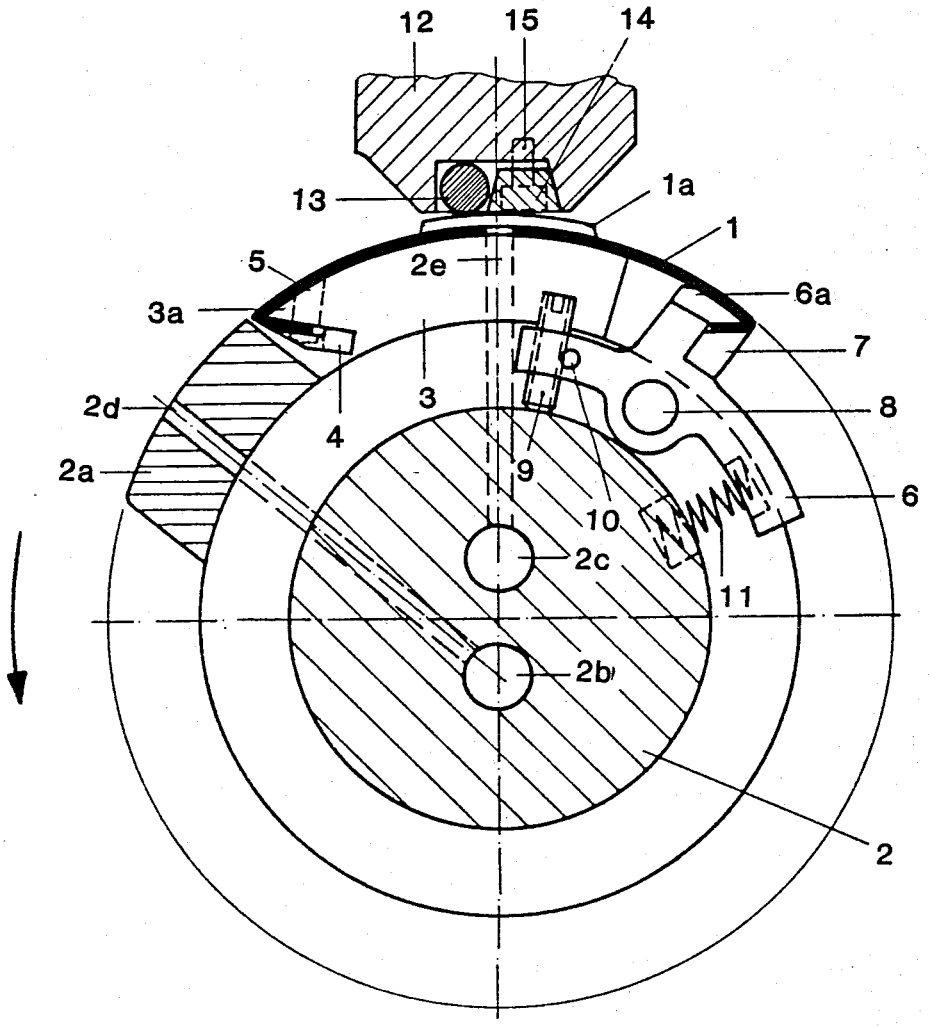
FIG. 1 is a partial cross-sectional view of the device of the present invention at right angles to the axis of rotation thereof.
Figure 5:
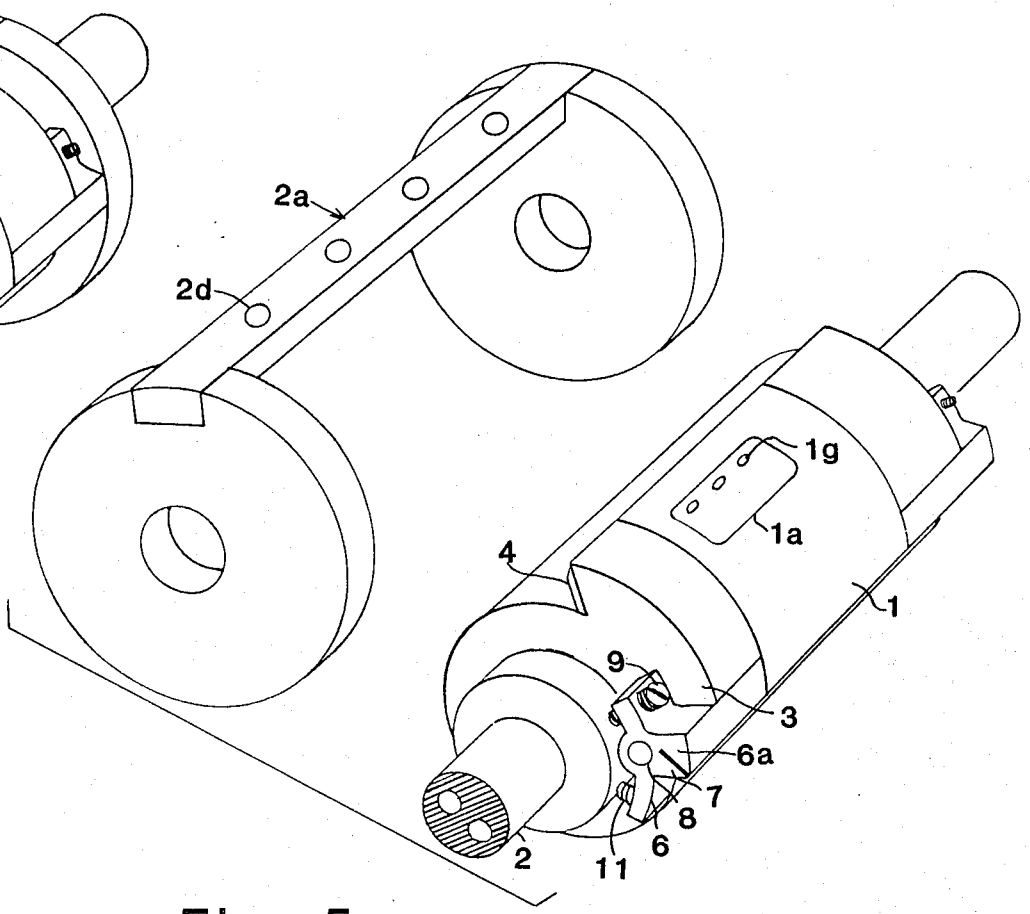
FIG. 5 is a partially exploded view of the rotating punch device shown in FIG. 4.
Figure 4:
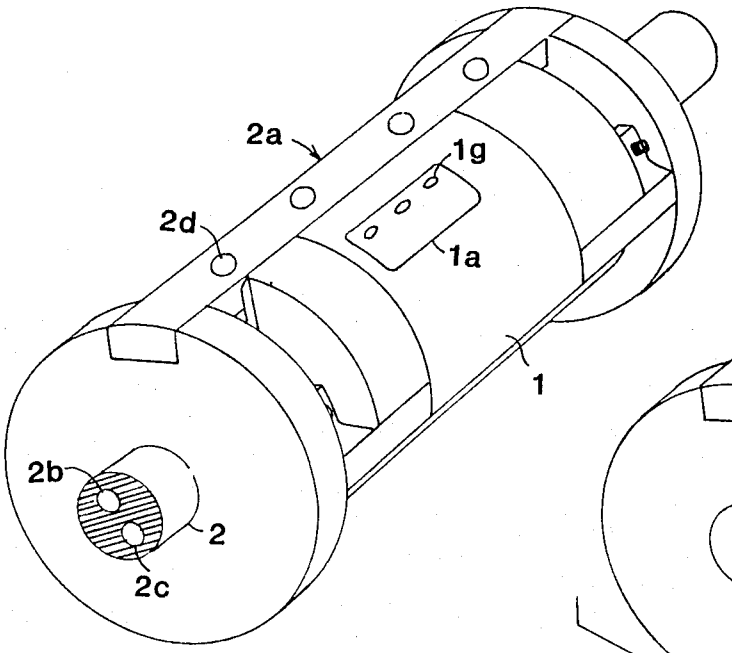
FIG. 4 is a perspective view of the rotating punch device according to the present invention.

FIGS. 1, 4 and 5 show the general construction of the rotating punch mechanism. A surface segment, designated 2*a*, is secured on a punching roller, designated 2, as clearly seen in FIG. 5. Air holes 2*b* and 2*c* pass through the core of roller 2 parallel to the axis of rotation and are connected to known valve means (not shown) for controlling the vacuum and blast air at the correct times. From air hole 2*b* a vacuum hole or a series of such holes, designated 2*d*, leads to the surface of segment 2*a*. Air hole 2*c* communicates—via a hole or a series of such holes, designated 2*e*, disposed consecutively—with the space inside the cutting edge 1*a* of foil 1. A retaining segment, designated 3, for foil 1 is fixed to roller 2. Its length in the direction of the axis of rotation is approximately equivalent to the width of foil 1. The tip 3*a* of the segment 3 together with a ledge 4 fixed to the segment forms a gap extending over the width of segment 3. A pin, designated 5, is also disposed in segment 3 in the middle of its width near the tip 3*a* and is adapted to engage U-shaped cut out 1*f* in foil 1 in order to axially register foil 1 on roller 2. The roller shoulder, bearing the segment 3, is substantially the same width as the segment and is drilled through widthwise to receive a bolt 8, on which are mounted clamping segments 6 disposed on either side of the roller shoulder, said segments being interconnected by a pointed rail 6*a*. Segments 6 are in the form of two-armed levers, one end of which has a screwthread to receive a clamp screw 9 while the other end is subject to the action of a compression spring 11 bearing in a small recess in roller 2. A plastic plug, designated 10, contacting the screwthread is provided to prevent the screw 9 from turning on its own. A rail, designated 7, is fixed to the segments 6 and together with the pointed rail 6*a* forms a gap extending over the width of foil 1. The stationary cutter bar 13 is clamped by a clamping bar 14 and screws 15 in a retaining rail 12 above roller 2 with the clamping means for foil 1.

To clamp foil 1, screws 9 are unscrewed as far as possible so that the compression springs 11 pivot the clamping segments 6 to the left. The end 1*d* of foil 1, bent at the edge 1*b*, is then introduced into the gap between the tip 3*a* of the segment 3 and the bar 4. The other end 1*e*, bent at the edge 1*c*, is introduced into the gap between the rails 6*a* and 7. The foil punch 1 is then clamped by simultaneously turning the two screws 9 against the force of the compression spring 11.

The material in which the windows are to be formed is retained on the surface segment 2*a* during conveyance and the cutting operation, by means of bores 2*d* through which vacuum is applied. The start and finish of the vacuum operation are controlled by known pneumatic valve means (not shown). The cut-out window is initially retained by vacuum via the vacuum holes 1*g* in foil 1 by way of the ducts 2*e* and 2*c* and after it leaves the cutting position it is blown into a bin by an air blast. The change from vacuum to blast air is also controlled by known pneumatic valve means (not shown).

It is understood that the foregoing general and detailed descriptions are explanatory of the present invention and are not to be interpreted as restrictive of the following claims.

What is claimed is:

1. A rotating punch device for making window cut-outs in envelope blanks and cardboard box blanks comprising:

(a) a punch roller;

(b) a metal foil disposed on said punch roller having a cutting edge in the shape of the window cut-out thereon, said metal foil having leading and trailing bent ends, one of said bent ends having a U-shaped cut-out therein;

(c) a retaining segment on said punch roller for engaging said bent end of said metal foil having the U-shaped cut-put therein, said segment including a pin disposed therein for engagement with said U-shaped cut-out to thereby accurately register said metal foil on said punch roller;

(d) a clamping segment on said punch roller for engaging the other bent end of said metal foil and clamping said metal foil onto said punch roller;

(e) a stationary cutting bar which cooperates with the cutting edge of said metal foil to form said window cut-out;

(f) a transport segment carried by said punch roller which grips the leading edge of said blank and transports said blank;

(g) vacuum openings disposed in said transport segment for the purpose of gripping the leading edge of said blank to be cut so that said blank can be conveyed and retained on said punch roller; and (h) vacuum openings within the cutting edge of said metal foil which are alternately subjected to vacuum and an air blast so as to control the discharge of the cut-out material.

* * * * *